US006565130B1

(12) United States Patent
Walsh, III

(10) Patent No.: US 6,565,130 B1
(45) Date of Patent: May 20, 2003

(54) DUAL ACTION LATCH RETRACTOR

(75) Inventor: John E. Walsh, III, Wallingford, CT (US)

(73) Assignee: Harrow Products, Inc., Woodcliff Lake, NJ (US)

( * ) Notice: Subject to any disclaimer, the term of this patent is extended or adjusted under 35 U.S.C. 154(b) by 0 days.

(21) Appl. No.: 10/004,712

(22) Filed: Dec. 5, 2001

(51) Int. Cl.[7] ..... E05B 65/10
(52) U.S. Cl. ..... 292/92; 292/93; 292/201
(58) Field of Search ..... 292/92, 93, 144, 292/201; 70/279.1, 282

(56) References Cited

U.S. PATENT DOCUMENTS 3,854,763 A * 12/1974 Zawadzki ..... 292/201
4,801,163 A * 1/1989 Miller ..... 292/92
4,976,476 A * 12/1990 Cross ..... 292/92
5,018,375 A * 5/1991 Tully ..... 70/472
5,340,171 A * 8/1994 Slaybaugh ..... 292/21
5,421,178 A * 6/1995 Hamel ..... 70/283

* cited by examiner

*Primary Examiner*—Gary Estremsky
(74) *Attorney, Agent, or Firm*—Michael Best & Friedrich LLP

(57) ABSTRACT

An exit bar employs a dual action latch retractor comprising a slotted link which connects manual and electrically actuated latch retraction means. The slot permits the latch to be retracted by a solenoid latch retractor regardless of the position of the push bar or other manual latch retraction means. A buffer spring transmits energy from the solenoid latch retractor to the push pad so that under normal circumstances actuation of the solenoid latch retractor retracts both the latch and push pad. However, if the push pad is jammed in the projected position, the buffer spring is compressed to permit relative movement between the solenoid latch retractor and the manual latch retraction mechanism. As soon as the force holding the push pad in an extended position is removed, the energy stored in the buffer spring is applied to the push pad through the mechanical linkage to retract the push pad.

14 Claims, 7 Drawing Sheets

DUAL ACTION LATCH RETRACTOR

BACKGROUND OF THE INVENTION

1. Field of the Invention

This invention relates to the field of door security systems. More specifically, this invention relates to the use of a push or exit bar for securing a doorway.

2. Description of the Related Art

Exit bars, also known as push bars or panic bars, that allow egress through a doorway while limiting ingress are well-known components of door security and emergency systems. The conventional exit bar is mounted on the interior side of the door to be secured and is oriented generally horizontally across the face of the door. A housing or frame supports a push pad or bar for receiving a push force. The push force applied to the movable push pad operates a door latch through a linkage to permit opening of the door. Conventional exit bars typically employ a mechanical linkage between the movable push pad and the latch to actuate the latch mechanism for unlatching the door.

To avoid excessive wear to the exit bar components during periods of high traffic through a doorway, it is known to fix or "dog" the exit bar in an unlocked condition. Typically, the push pad is locked in its depressed or actuated position to avoid unnecessary wear to the associated linkage. It is also known to equip an exit bar with an electromagnetic latch retractor as described in U.S. Pat. No. 6,104,594, assigned to the assignee of the present invention. By integrating a building security system with exit bars including electromagnetic latch retractors, it is possible to effectuate the latching and unlatching of exit bars remotely and/or automatically.

U.S. Pat. No. 6,104,594 describes the use of an electric circuit to generate a high energy pulse through the electromagnet to generate a retraction force sufficient to retract the push pad and with it the mechanical linkage and latch to unlock the door. A possible deficiency of this approach is that, if the push pad is held or jammed in an extended position, the latch cannot be retracted by the electromagnet (even at high power). An alternative arrangement is to apply the electromagnetic retraction force only to the latch, without also retracting the push pad as described in U.S. patent application Ser. No. 09/414,202, filed Oct. 7, 1999 and also assigned to the assignee of the present invention. This permits latch retraction regardless of the position of the push pad. However, in high traffic situations, the push pad and its associated linkages are free to move as people push to open the door and are exposed to the resulting high rates of wear.

There is a need in the art for an exit bar equipped with remotely actuateable means for retracting the latch as well as the push pad which will reliably retract the latch even if the push pad is jammed in an extended position.

SUMMARY OF THE INVENTION

An object of the present invention is to provide a new and improved dual action latch retractor for retracting the push pad and latch of an exit bar that will reliably retract the latch regardless of the position of the push pad.

Another object of the present invention is to provide a new and improved dual action latch retractor for remotely retracting the push pad and latch of an exit bar.

These and other objects are achieved in an exit bar in which a slotted link is used to connect a solenoid latch retractor to the push pad and the associated manual latch retraction mechanism. The slot permits the latch to be retracted by the solenoid latch retractor regardless of the position of the push bar. A buffer spring transmits energy from the solenoid latch retractor to the push pad so that under normal circumstances actuation of the solenoid latch retractor retracts both the latch and push pad. However, if the push pad is jammed in the projected position, the buffer spring is compressed to permit relative movement between the solenoid latch retractor and the manual latch retraction mechanism. Compression of the buffer spring permits the latch to be retracted while the push pad remains in the extended position. As soon as the force holding the push pad in an extended position is removed, the energy stored in the buffer spring is applied to the push pad through the mechanical linkage to retract the push pad.

BRIEF DESCRIPTION OF THE DRAWINGS

Other objects and advantages of the invention will be evident to one of ordinary skill in the art from the following detailed description, made with reference to the accompanying drawings, in which.

DETAILED DESCRIPTION OF THE PREFERRED EMBODIMENT

Figure 1:
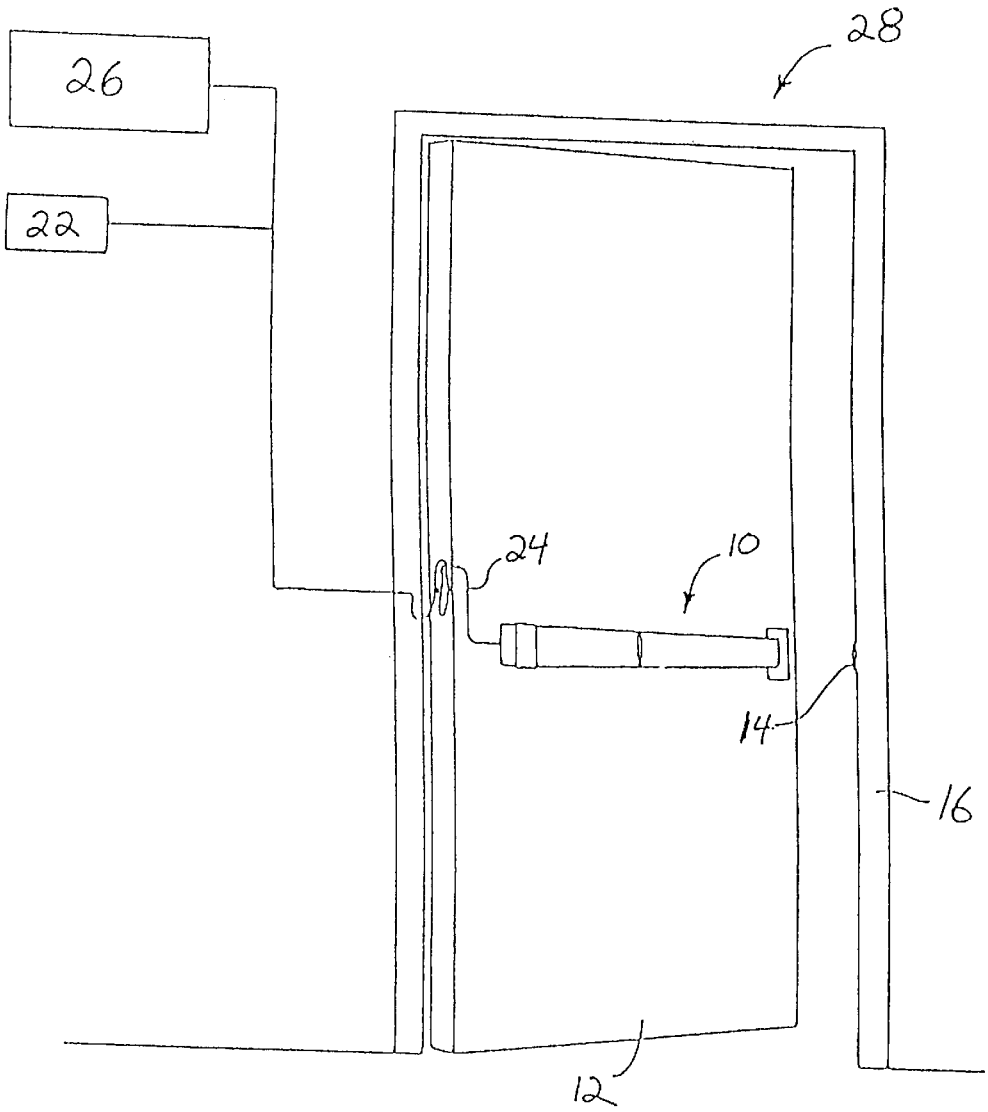
FIG. 1 is a schematic view of an exit bar equipped with a dual action latch retractor in accordance with the present invention mounted to a door and illustrating various auxiliary features thereof.

With reference to the drawings, wherein like numerals represent like components or structures throughout the several Figures, a preferred embodiment of an exit bar equipped with a dual action latch retractor in accordance with the present invention is generally designated by the numeral 10. The exit bar 10 is mounted in a horizontal position across the interior side of a door 12 to be secured (FIG. 1). The exit bar 10 latches against a strike 14 mounted to the door frame from which the door 12 is supported. A push force applied at the front of the exit bar 10 retracts the latch bolt 42 from the strike 14 and releases the door 12 to open for egress. Power is supplied to the exit bar 10 from a remote power source 22 over lines 24 in a conventional manner.

Exit bars in accordance with the present invention are readily adaptable for communication with a remote control or security system 26. The remote security system 26 can be used to issue commands to the exit bar 10 to remotely unlatch the door and also to maintain the door in an unlatched state.

With reference to FIGS. 1A through 6, the exit bar 10 has an elongated main housing 32 which mounts to the door face to support and surround the exit bar internal components. The length of the housing 32 is preferably sufficiently long to substantially span the width of the door 12. The main housing 32 is mounted to the door by means of screws or other fasteners (not shown) which secure the back panel 34 of the housing 32 in surface to surface disposition to the interior (secured) face of the door 12. The main housing 32 is preferably a channel shaped extrusion defining an elongated opening spaced away from the face of the door 12. A transversely displaceable push pad 36 defines a push face for receiving a push force exerted toward the door 12 by a person attempting egress through the door. The push pad 36 preferably spans a substantial longitudinal portion of the housing 32 adjacent that end of the housing closest the latch assembly 18.

Fixed inside the main housing 32 is a frame 40. The generally channel shaped frame 40 is secured to the back panel 34 of the main housing 32 by screws or other fasteners (not shown). For purposes of describing the invention as viewed in FIGS. 1A through 6, the main housing 32 defines a central longitudinal axis which extends parallel to the back panel 34 and a transverse axis which extends perpendicularly from the back panel 34.

The exit bar secures the door by use of a latch assembly 18 that may encompass a variety of forms. The latch assembly includes a retractable or releasable latch bolt 42 which is pivotally mounted to a latch frame 20. The latch bolt 42 is biased toward an extended or latched position by a latch pre load spring 23 that acts on a latch link 21. A latch cover 19 surrounds the latch housing 20 to keep contaminants from the latch assembly 18. When push pad 36 is pushed into the housing 32 by a person attempting egress, a pair of parallel push pad rails 44 mounted to the push pad 36 are moved toward the rear panel 34 of the exit bar 10.

Figure 2:
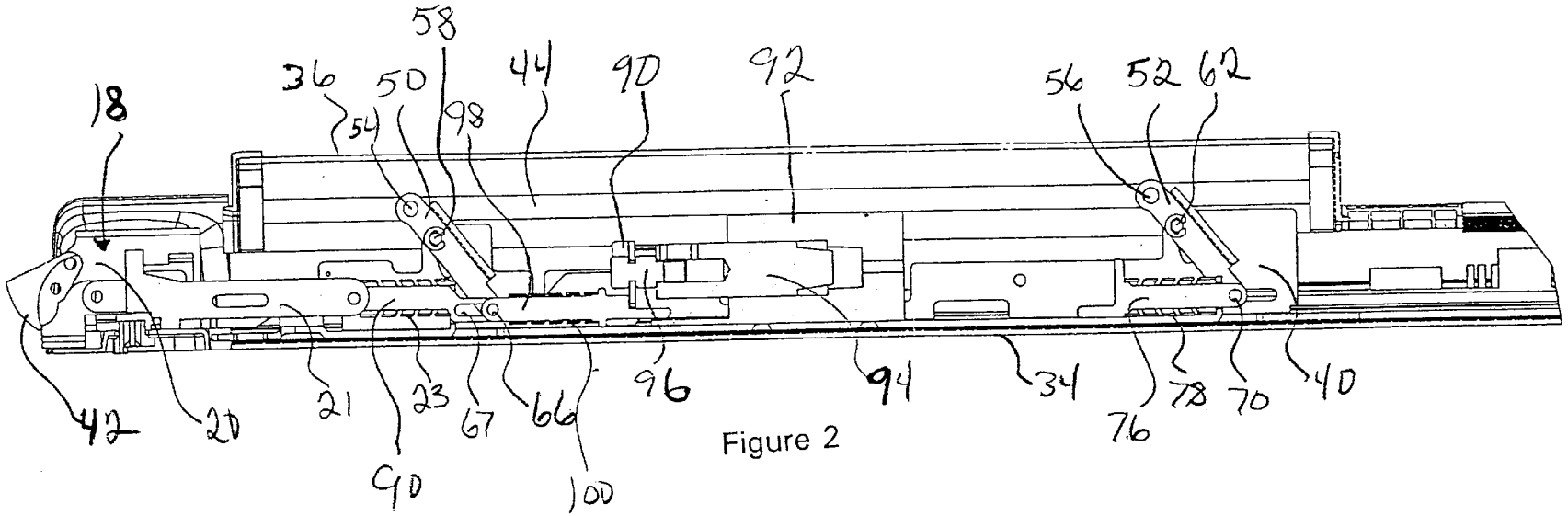
FIG. 2 is a sectional view through the exit bar of FIG. 1A, taken along line 2—2 thereof and including the push pad.
Figure 3:
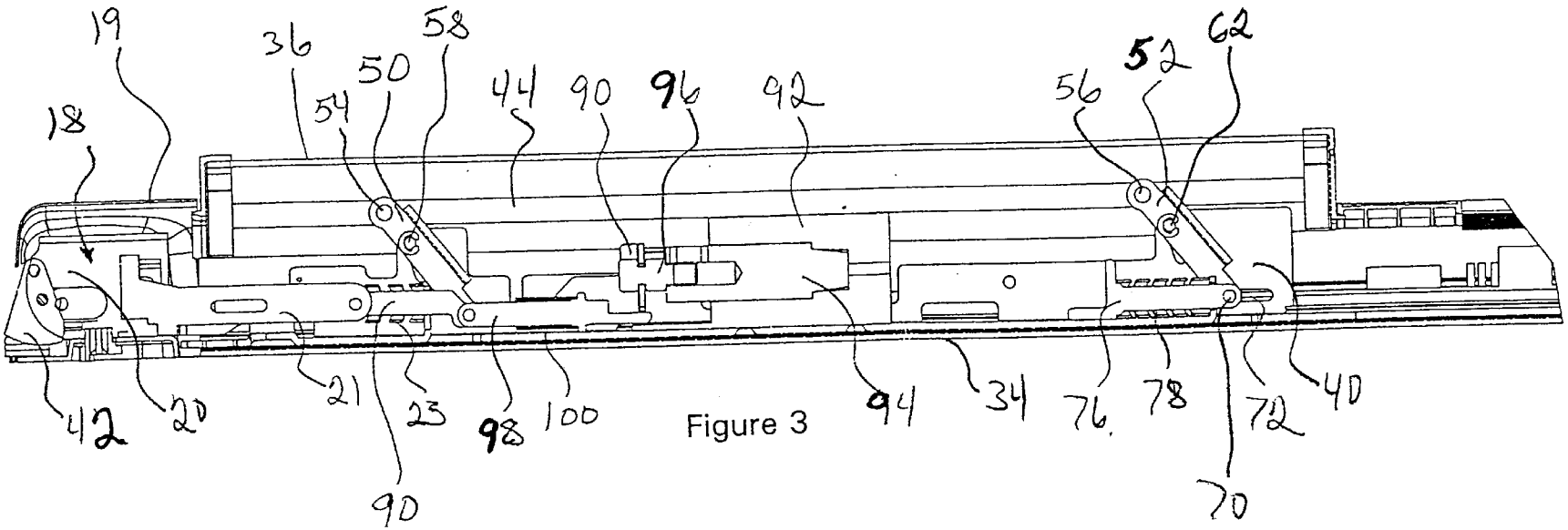
FIG. 3 is the sectional view of FIG. 2 with the solenoid energized and the push pad in an extended position.
Figure 4:
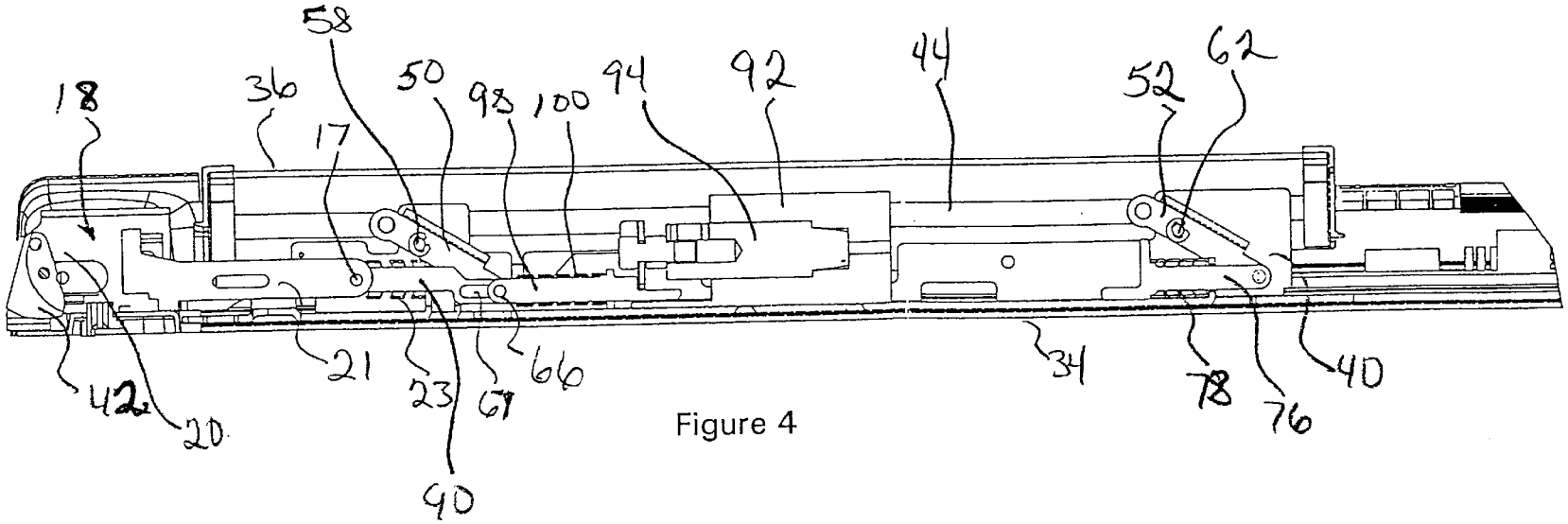
FIG. 4 is the sectional view of FIG. 2 with the solenoid energized and the push pad in a retracted position.
Figure 6:
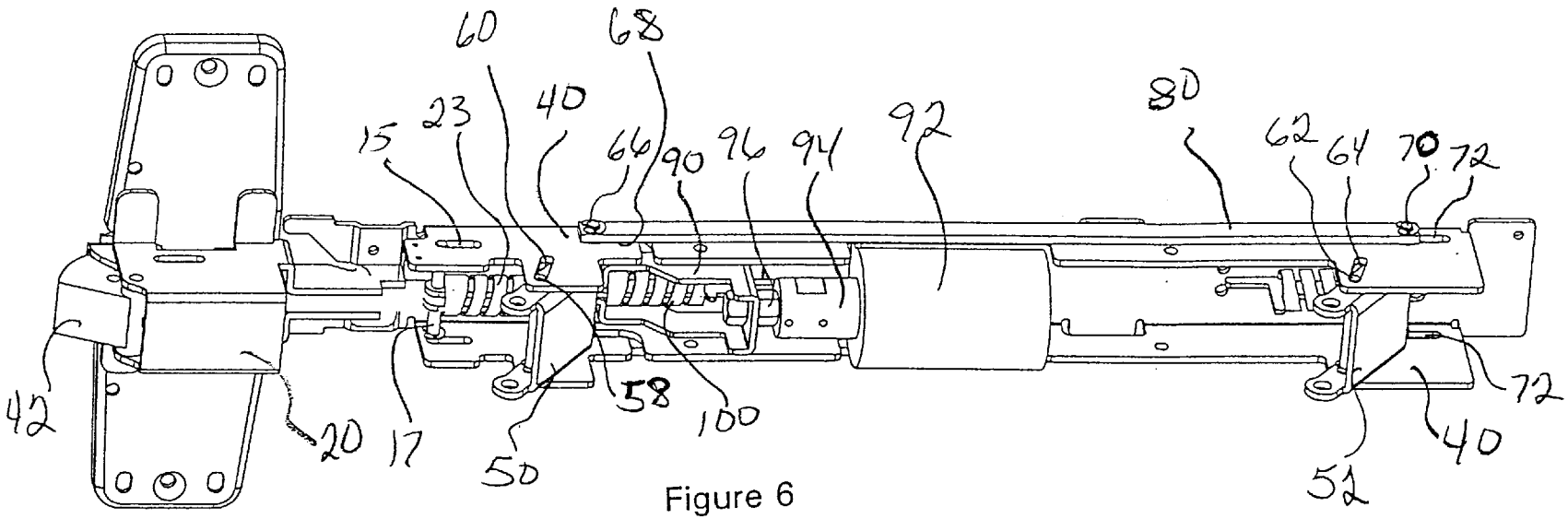
FIG. 6 is a perspective view of the latch mechanism, mechanical linkage and solenoid latch retractor of the exit bar shown in FIGS. 1A through 5 with the push pad, latch mechanism cover and housing removed.

With reference to FIGS. 2 through 4, the push pad 36 is mounted to longitudinally extending rails 44 which are pivotally linked to the frame 40 by a master main link 50 and a slave main link 52. The master main link 50 and slave main link 52 are pivotally connected to the rails 44 by pins 54, 56 respectively. As best seen in FIG. 6, a master main link pin 58 extends through the master main link 50 and slidably engages in master main link slots 60 defined by the frame 40. In a similar construction, a slave main link pin 62 extends through the slave main link 52 and slidably engages in slave main link pin slots 64 defined by the frame 40.

As viewed in FIGS. 2 through 4, the master and slave main links 50, 52 extend from the rails 44 to almost the bottom of the channel defined by the frame 40. A second master main link pin 66 extends through the master main link 50 and slidably engages in master main link lower slots 68 (hidden by auxiliary rail 80 in FIGS. 2–4) defined by frame 40. A second slave main link pin 70 extends through the slave main link 52 and slidably engages in slave main link lower slots 72 defined by frame 40. The master and slave lower guide slots 68, 72 are oriented generally parallel to the back panel 34 of the housing 32 in the longitudinal direction. A main spring guide 76 is engaged by the second slave link pin 70. A main spring 78 is compressively engaged between the main spring guide 76 and a flange formed by the frame 40 to bias the push pad 36 and associated master and slave main links 50, 52 toward a projected position (best seen in FIGS. 2 and 3).

Opposed auxiliary rails 80 connect the master and slave main links 50, 52 at their second master and slave main link pins 66, 70. The construction of the master and slave main links 50, 52 and the associated pins and slots define a transverse path of motion, e.g., toward the door, for the push pad 36 and rails 44. Upon application of a push force, the transverse motion of the rails 44 and push pad 36 toward the door is translated into a generally longitudinal motion away from the latch 42 at second master main link pin 66 and second slave main link pin 70. The provision of auxiliary rails 80 linking second master and slave main link pins 66, 70 ensures that a push force applied to either end of the push bar 36 will result in a substantially equivalent longitudinal motion at the bottom of the master main link 50.

The master and slave main links 50, 52, master and slave link slots 60, 64, lower guide slots 68, 72, rails 44, push pad 36 and auxiliary rails 80 act in concert to form a manual latch retraction mechanism which translates a push force applied to the push pad into a longitudinal latch retraction force at the second master main link pin 66 located at the bottom of the master main link 50. As best seen in FIGS. 2–4, the second master main link pin 66 passes through a slot 67 defined by a solenoid link 90. The solenoid link is operatively connected between a solenoid plunger 94 and latch link 21 for transmitting a retraction force generated by the solenoid 92 to the latch assembly 18. An adjuster 96 (best seen in FIG. 6) fixes one end of the solenoid link to the solenoid plunger 94. The adjuster permits fine tuning of the position of the solenoid link relative to the solenoid plunger 94 and solenoid 92. The adjuster 96 has a shaft that penetrates an axial bore in the solenoid plunger 94. The shaft is fixed in a selected position relative to the plunger 94 by set screws (not shown) in bores that intersect the axial bore.

Figure 1A:
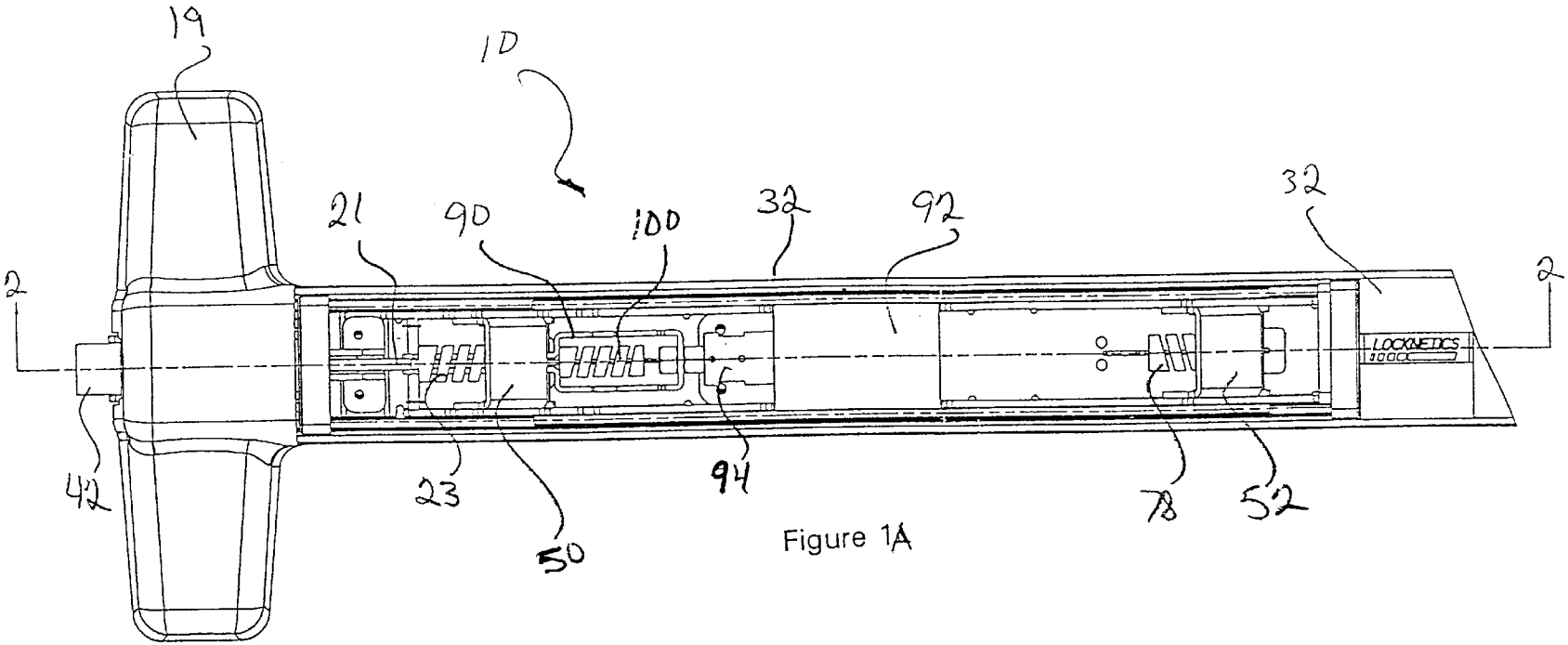
FIG. 1A is a partial enlarged front view of the exit bar of FIG. 1, with the push pad removed.
Figure 5:
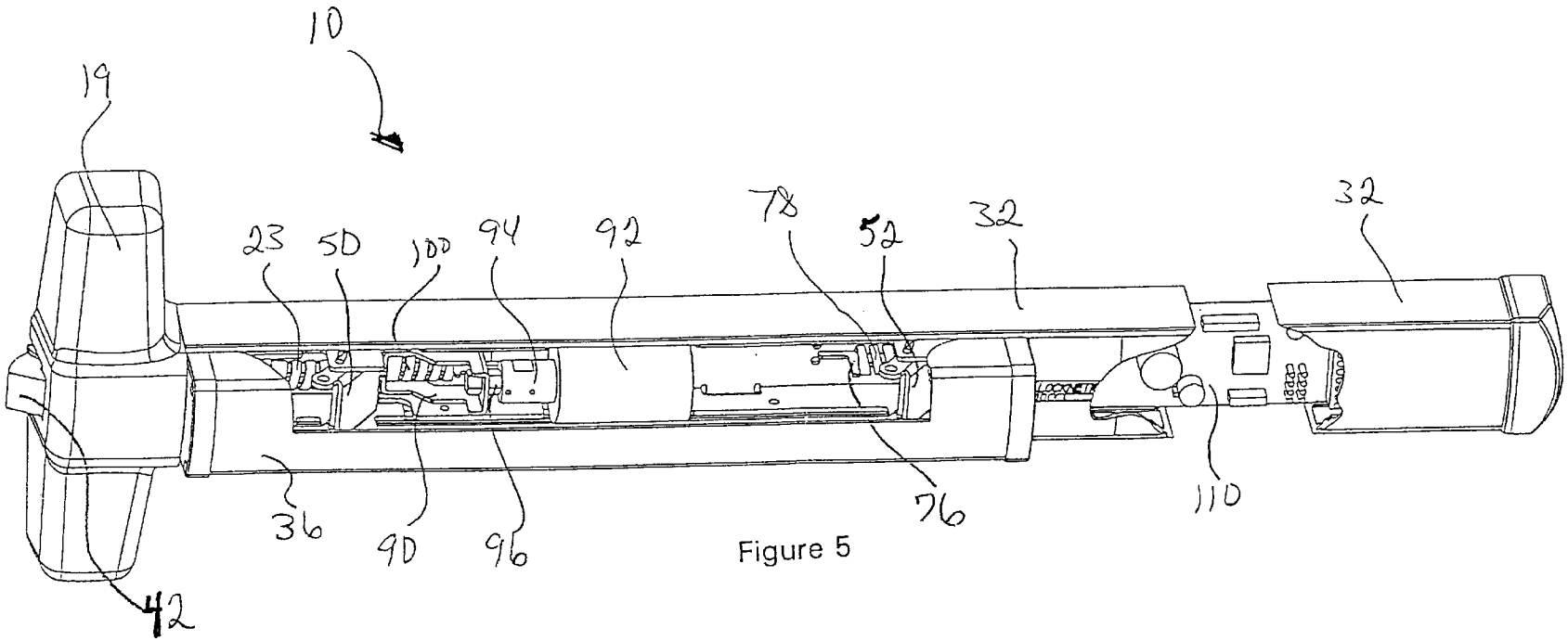
FIG. 5 is a perspective exterior view of the exit bar of FIG. 1A with portions of the push pad and housing removed.

As best seen in FIGS. 1A, 5 and 6, the solenoid link defines a yoke comprising two transversely spaced arms which extend longitudinally toward the latch assembly before bending toward each other to define a parallel, closely spaced connection on either side of the latch link 21. Solenoid link 90 and latch link 21 are connected by a pin 17 which is slidably engaged in longitudinal slots 15 defined by the frame 40 (see FIG. 6).

A coiled buffer spring 100 surrounds a buffer spring guide 98 disposed between the arms of the solenoid link 90. Pin 66 passes through one end of the buffer spring guide to fix the guide relative to the lower end of the master main link 50. The closely spaced arms of the solenoid link 90 define a solenoid link slot 67. Second master main link pin 66 extends transversely through the outer auxiliary rails 80, lower guide slots 68 defined by the frame, master main link 50, solenoid link slot 67 and the buffer spring guide 98. Thus, the second master main link pin 66 is movable in a longitudinal direction relative to the frame 40 in longitudinal slots 68 and also in solenoid link slot 67 relative to the solenoid link.

The function of an exit bar 10 equipped with a dual-action latch retractor in accordance with the present invention will now be described with reference to FIGS. 1A through 6. FIGS. 1A, 2, 5 and 6 illustrate the relative positions of the components of the exit bar 10 in a stable, latched condition. Latch 42 is biased toward its extended latched position by latch preload spring 23, which is compressively engaged between a flange of the frame 40 and connecting pin 17 which joins the arms of the solenoid link 90 to the latch link 21. Push pad 36 and the associated parts of the manual latch retraction mechanism are biased toward an outwardly projected position by main spring 78. Main spring 78 is compressively engaged between the main spring guide 76 and a flange projecting from the frame 40. It should be noted that latch preload spring 23 biases the latch 42 toward its projected latched position and also biases the solenoid link 90 and attached solenoid plunger 94 toward the position illustrated in FIG. 2.

A push force applied to the push pad is coupled by rails 44 to the upper end of the master and slave main links 50, 52 through pins 54, 56. The master and slave main links 50,52 move inwardly relative to the exit bar housing 32 and frame 40 with master main link pin 58 and slave main link pin 62 guided in master and slave main link pin slots 60, 64. It should be noted that the master and slave main link slots 60,64 are angled such that movement of the push pad 36 relative to the exit bar housing 32 and latch cover 19 is substantially perpendicular, e.g., toward the face of the door 12. The inward and pivoting movement of master and slave main links 50, 52 in response to a push force causes master and slave second main link pins 66, 70 to move longitudinally away from the latch assembly 18 in slots 68, 72. When the push bar has been fully compressed into the exit bar housing 32 by a push force, second main link pin 66 has reached the end of solenoid link slot 67 and exerted a retraction force on the latch 42 via the latch link 21 (see FIG. 4). In this position, the main spring 78 is compressed between the main spring guide and the frame 40. Buffer spring 100 is not compressed because the relative positions of the solenoid link 90 and the master main link 50 lower end have not changed. In other words, second main link pin 66 is still at the right hand end of solenoid link slot 67. Release of the push force against the push pad 36 will permit the main spring 78 and latch pre load spring 23 to return the components of the exit bar to their extended latched positions as illustrated in FIG. 2.

An exit bar 10 equipped with a dual-action latch retractor in accordance with the present invention may also be unlocked, e.g., latch 42 retracted, by actuation of solenoid 92. The exit bar 10 is equipped with control electronics 110 for generating current in solenoid 92 to produce a magnetic field which in turn creates a retraction force on solenoid plunger 94. Solenoid, link 90 and connected latch link 21 apply the retraction force generated by the solenoid to the latch 42. The dual-action latch retractor in accordance with the present invention is configured to retract both the latch 42 and the push bar 36 with its associated linkages. Retracting the latch 42 releases the door 12 for egress while retracting the push pad 36 and its associated manual latch retraction mechanism avoids excessive wear on the mechanism during periods of high traffic through the door.

Since the latch retraction force generated by the solenoid must also retract the push pad 36 and its associated manual latch-retraction mechanism, the initial force generated by the solenoid 92 must be substantial. Therefore, the control electronics 110 are capable of generating an initial high-current pulse to overcome the inertia of the push pad 36 and its associated manual latch retraction mechanism as well as overcoming the force exerted on the latch by the latch preload spring 23. Maintaining the components of the exit bar in the positions illustrated in FIG. 4 requires less current than the initial movement thereto, so the control electronics also provide a lower current retaining power to the solenoid 92 following the initial retraction pulse.

In accordance with a particular aspect of the present invention, the dual-action latch retractor is provided with means for permitting relative movement between the solenoid link 90 and the lower end of the master main link 50 (second master main link pin 66). This allows the retraction force generated by the solenoid 92 to retract the latch 42 regardless of the position of the push pad 36 and its associated manual latch-retraction mechanism. It is advantageous for the door to be capable of remote automated release even when the push pad 36 and/or the manual latch retraction mechanism are jammed in their extended latched positions. Further, it is advantageous that when the jamming force is released, the dual-action latch retractor then retract the push pad 36 and its associated manual latch-retraction mechanism to avoid wear commonly associated with high traffic situations.

These objects are achieved in the illustrated preferred embodiment by applying the retraction force generated by the solenoid 92 to the master main link 50 through a buffer spring 100. When the push bar is free to move and the solenoid is actuated, the buffer spring 100 efficiently transmits the retraction force to the lower end of the master main link 50 to retract the push pad and the manual latch-retraction mechanism. If the push pad is jammed, as illustrated in FIG. 3, the solenoid 92 is still capable of retracting the latch 42 via the solenoid link 90 and the latch link 21. The buffer spring 100 is compressed by the altered relative positions of the master main link second pin 66 and the solenoid link 90. As can be seen in FIG. 3, pin 66 has moved to the left end of solenoid link slot 66 thereby compressing the buffer spring 100 which is engaged between the buffer spring guide 98 and the solenoid link 90. When the jamming force is removed, energy stored in the compressed buffer spring 100 is sufficient to retract the push pad and the associated manual latch-retraction mechanism.

Thus, the dual-action latch retractor in accordance with the present invention is capable of retracting both the latch and the manual latch-retraction mechanism of an exit bar regardless of the position of the push pad relative to the exit bar housing 32. The exit bar 10 is fully integratable with building security and alarm systems, permitting remote automatic release and dogging of the latch and manual latch-retraction mechanisms, respectively.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A dual action latch retractor comprising:

an actuator electrically actuatable to generate a first latch retraction force;

a solenoid link extending from a first end fixed to said actuator to a second end operatively connected to retract a latch and comprising means for permitting relative movement between said solenoid link and a manual latch retraction mechanism operatively connected to said solenoid link;

said manual latch retraction mechanism configured to translate a manual force applied to an operator into a second latch retraction force and apply said second latch retraction force to said solenoid link to retract said latch, said manual latch retraction mechanism biased toward a first position and movable to a second position to retract said latch in response to application of said manual force to said operator; and bias means for biasing, said manual latch retraction mechanism relative to said solenoid link so that said first retraction force is applied through said bias means and said manual latch retraction mechanism to move said operator from said first position to said second position, wherein said means for permitting relative movement permits retraction of said latch by said first latch retraction force regardless of the position of said manual latch retraction mechanism.

2. The dual action latch retractor of claim 1, wherein said actuator comprises a solenoid including an electromagnet and a plunger attracted by a magnetic field generated by said electromagnet to generate said first latch retraction force, said solenoid link first end being fixed to said plunger.

3. The dual action latch retractor of claim 1, wherein said bias means comprises a buffer spring and when said first latch retraction force is applied to said solenoid link with said manual latch retraction mechanism held in said first position, said buffer spring compresses to store a portion of said first latch retraction force and when said manual latch retraction mechanism is released, said buffer spring applies said stored force through said manual latch retraction mechanism to move said operator from said first position to said second position.

4. The dual action latch retractor of claim 1, wherein said means for permitting relative movement comprises a slot in said solenoid link and said manual latch retraction mechanism is operatively connected to said solenoid link by a pin movable in said slot.

5. The dual action latch retractor of claim 1, wherein said means for permitting relative movement comprises a slot in said solenoid link and said manual latch retraction mechanism is operatively connected to said solenoid link by a pin movable in said slot, said dual action latch retractor further comprising a buffer spring guide connected to said manual latch retraction mechanism by said pin and including protrusions, wherein said buffer spring surrounds said buffer spring guide and is compressibly engaged between said solenoid link and said protrusions such that movement of said pin in said slot caused by said manual latch retraction mechanism being held in said first position during application of said first latch retraction force to said solenoid link compresses said buffer spring and when said manual latch retraction mechanism is released, said buffer spring expands to move said manual latch retraction mechanism from said first position to said second position.

6. The dual action latch retractor of claim 3, wherein said operator and manual latch retraction mechanism are biased toward said first position by a main spring having an axis, said buffer spring having an axis parallel to said main spring axis.

7. The dual action latch retractor of claim 2, wherein said solenoid plunger includes an adjuster for fixing said solenoid link first end in a selected position relative to said plunger and electromagnet.

8. An exit bar comprising:

a retractable latch biased toward a projected latched position;

a manual latch operator operatively connected to a manual latch retraction mechanism, a force applied to said operator being translated by said manual latch retraction mechanism into a first latch retraction force, said operator and manual latch retraction mechanism movable between a first latched position and a second latch retraction position;

a solenoid comprising a coil and a plunger, an electrical current applied to said coil generating a second latch retraction force;

a mechanical connection between said latch, said manual latch retraction mechanism and said solenoid plunger comprising a solenoid link; and means for selectively permitting relative movement between said manual latch retraction mechanism and said solenoid link, said means for selectively permitting relative movement including a slot in said solenoid link, a pin slidable in said slot and engaged with said manual latch retraction mechanism, a buffer spring operatively connected so that said second latch retraction force is transmitted to said manual latch retraction mechanism through said buffer spring, wherein if said operator is held in said first latched position during application of said second latch retraction force, said buffer spring is compressed and when said operator is released, said compressed buffer spring releases energy to move said operator and manual latch retraction mechanism to said second retraction position, said relative movement occurring when said manual latch operator fails to move in response to said second latch retraction force, wherein said first latch retraction force moves said solenoid link to retract said latch and said second latch retraction force moves said solenoid link to retract said latch regardless of the position of said operator and manual latch retraction mechanism.

9. An exit bar comprising:

a retractable latch biased toward a projected latched position;

a solenoid comprising a coil and a plunger, an electrical current applied to said coil generating a first retraction force;

a mechanical connection between said latch and said solenoid plunger comprising a solenoid link, said solenoid link defining a slot;

a manual latch retraction mechanism including an operator for receiving a manual latch retraction force which, when applied to said operator is translated by said manual latch retraction mechanism into a second retraction force, said operator and manual latch retraction mechanism movable between a first latched position and a second latch retraction position;

a buffer spring arranged such that said first retraction force is applied to said manual latch retraction mechanism through said buffer spring; and a buffer spring guide fixed relative to said pin, wherein said buffer spring surrounds said buffer spring guide and is compressively engaged between said buffer spring guide and said solenoid link, and wherein said manual latch retraction mechanism is operatively connected to said solenoid link by a pin slidably engaged in said slot such that said second retraction force moves said solenoid link to retract said latch and said first retraction force moves said solenoid link to retract said latch regardless of the position of said operator and manual latch retraction mechanism.

10. The exit bar of claim 9, further comprising a main spring having an axis and operatively connected to bias said manual latch retraction mechanism and operator toward said first latched position, said buffer spring having an axis parallel to said main spring axis.

11. The exit bar of claim 10, wherein said latch is biased toward said projected latched position by a latch preload spring having an axis parallel to said main spring axis and buffer spring axis.

12. An exit bar comprising:

a retractable latch biased toward a projected latched position;

a solenoid comprising a coil and a plunger, an electrical current applied to said coil generating a first retraction force;

a mechanical connection between said latch and said solenoid plunger comprising a solenoid link, said solenoid link defining a slot;

a manual latch retraction mechanism including an operator for receiving a manual latch retraction force which, when applied to said operator is translated by said manual latch retraction mechanism into a second retraction force, said operator and manual latch retraction mechanism movable between a first latched position and a second latch retraction position; and a buffer spring arranged such that said first retraction force is applied to said manual latch retraction mechanism through said buffer spring;

wherein said solenoid link comprises two spaced apart arms defining a yoke and said buffer spring is disposed between said arms, and wherein said manual latch retraction mechanism is operatively connected to said solenoid link by a pin slidably engaged in said slot such that said second retraction force moves said solenoid link to retract said latch and said first retraction force moves said solenoid link to retract said latch regardless of the position of said operator and manual latch retraction mechanism.

13. The exit bar of claim 12, comprising a main spring having an axis and operatively connected to bias said manual latch retraction mechanism and operator toward said first latched position, said buffer spring having an axis parallel to said main spring axis.

14. The exit bar of claim 13, wherein said latch is biased toward said projected latched position by a latch preload spring having an axis parallel to said main spring axis and buffer spring axis.

* * * * *